US007722346B2

(12) United States Patent
Kishi et al.

(10) Patent No.: US 7,722,346 B2
(45) Date of Patent: May 25, 2010

(54) OIL SUPPLY METHOD OF TWO-STAGE SCREW COMPRESSOR, TWO-STAGE SCREW COMPRESSOR APPLYING THE METHOD, AND METHOD OF OPERATING REFRIGERATING MACHINE HAVING THE COMPRESSOR

(75) Inventors: Takayuki Kishi, Koto-ku (JP); Kazuya Yamada, Koto-ku (JP); Toshiyuki Sakaguchi, Koto-ku (JP); Tomoo Takenoshita, Koto-ku (JP)

(73) Assignee: Mayekawa Mfg. Co., Ltd. (JP)

( * ) Notice: Subject to any disclaimer, the term of this patent is extended or adjusted under 35 U.S.C. 154(b) by 22 days.

(21) Appl. No.: 11/965,664

(22) Filed: Dec. 27, 2007

(65) Prior Publication Data

US 2008/0152524 A1 Jun. 26, 2008

Related U.S. Application Data

(63) Continuation of application No. PCT/JP2005/011911, filed on Jun. 29, 2005.

(51) Int. Cl.
*F01C 1/16* (2006.01)

(52) U.S. Cl. ..... 418/201.1; 418/201.2

(58) Field of Classification Search ..... 418/201–201.3
See application file for complete search history.

(56) References Cited

U.S. PATENT DOCUMENTS 3,265,293 A * 8/1966 Schibbye ..... 418/1
3,432,089 A * 3/1969 Schibbye ..... 418/88
3,820,923 A * 6/1974 Zweifel ..... 418/84
3,885,402 A * 5/1975 Moody et al. ..... 62/505
3,910,731 A * 10/1975 Persson et al. ..... 418/9
4,062,199 A * 12/1977 Kasahara et al. ..... 62/197
4,080,119 A * 3/1978 Eriksson ..... 418/97
4,394,113 A * 7/1983 Bammert ..... 418/98
4,497,185 A * 2/1985 Shaw ..... 62/468
5,653,585 A * 8/1997 Fresco ..... 418/100
6,129,533 A * 10/2000 Brandt et al. ..... 418/104
6,506,027 B1 * 1/2003 Timuska ..... 417/251
6,644,045 B1 * 11/2003 Tang et al. ..... 62/116

FOREIGN PATENT DOCUMENTS

JP 62-78386 U 5/1987

(Continued)

OTHER PUBLICATIONS

Search Report issued in corresponding application No. PCT/JP2005/011911, mailed on Oct. 4, 2005.

*Primary Examiner*—Thomas Denion
*Assistant Examiner*—Douglas Duff
(74) *Attorney, Agent, or Firm*—Rossi, Kimms & McDowell LLP

(57) ABSTRACT

A method of supplying lubrication oil to a two-stage screw compressor is disclosed in which a low-pressure stage screw compressor and a high-pressure stage screw compressor are integrally constructed. A compression space is formed by a male rotor and a female rotor, and operation gas is fed for compression to the compression space. The method prevents degradation of volumetric efficiency caused by return of lubrication oil, coming from a bearing and a shaft sealing device, to the low-pressure stage screw compressor, and as a result, refrigeration capacity is improved and the amount of the lubrication oil is reduced.

2 Claims, 5 Drawing Sheets

FOREIGN PATENT DOCUMENTS

| | | | |
|---|---|---|---|
| JP | 2-94390 | U | 7/1990 |
| JP | 9-268988 | A | 10/1997 |
| JP | 9-273820 | A | 10/1997 |
| JP | 2002-242848 | A | 8/2002 |
| JP | 2002-266782 | A | 9/2002 |
| JP | 2002-286307 | A | 10/2002 |
| JP | 2003-130473 | A | 5/2003 |
| JP | 3653330 | B2 | 3/2005 |

* cited by examiner

OIL SUPPLY METHOD OF TWO-STAGE SCREW COMPRESSOR, TWO-STAGE SCREW COMPRESSOR APPLYING THE METHOD, AND METHOD OF OPERATING REFRIGERATING MACHINE HAVING THE COMPRESSOR

This is a continuation of International Application PCT/JP2005/011911 (published as WO 2007/000815) having an international filing date of 29 Jun. 2005, the disclosure of which, in its entirety, including the drawings, claims and the specification thereof, is incorporated herein by reference.

TECHNICAL FIELD

The present invention is related to a method of supplying refrigerating machine oil dissolving operating gas to a two-stage screw compressor in order to prevent exacerbation in volumetric efficiency of the compressor due to operating gas flash evaporated from the refrigerating machine oil, a two-stage screw compressor to which the method is applied, and a refrigerating machine using the two-stage screw compressor as its constituent compressor.

BACKGROUND ART

Generally, in a screw compressor, lubricating oil is supplied to bearings supporting rotors and oil is injected into the compression cavities formed by the rotors and rotor casing to aid sealing the gap between the rotors and the gap between the rotors and the casing, and also to provide cooling sink for the gas charge in order to increase volumetric and thermal efficiencies.

Such a screw compressor requires a large amount of lubricating oil for lubricating the bearings and shaft seal element and for lubricating the rotors and cooling the gas charge. When operating gas dissolving type refrigerating machine oil is used as lubricating oil, operating gas dissolved in the oil is flash-evaporated from the oil in the compression cavities, which induces early pressure rise in the compression cavities resulting in increased leak of the gas charge toward the suction side and decreased volumetric efficiency.

Conventionally, it has been thought effective to decrease amounts of gas charge, i.e. operating gas dissolved in the oil as far as possible in order to minimize the influence as mentioned above.

Dissolution characteristic of operating gas into lubricating oil is such that, the higher the pressure and the lower the temperature of oil, the larger the amount of operating gas dissolved into the oil. Therefore, it is thought effective to increase discharge temperature of the gas charge in order to decrease dissolved amounts of operating gas, and various devisal has been made.

However, when discharge temperature is raised too much, scuffing of rotors occurs due to thermal expansion of the rotors lubrication of the bearings and shaft seal elements becomes insufficient due to heat transferred to them from the rotor casing. Therefore, elimination of the affection of flash-evaporation of dissolved operating gas has not been achieved sufficiently by increasing discharge temperature. Particularly, in the case of two-stage screw compressor, when high pressure oil dissolving a large amount of operating gas is supplied to the bearings, shaft seal element, and compression cavities of the low-pressure stage compressor, proportion in weight of operating gas flash-evaporated from lubricating oil relative to operating gas sucked in the compressor increases due to lower pressure in the compression cavities of the low-pressure stage compressor, and compression efficiency of the compressor decreases.

In the case of a conventional two-stage screw compressor, lubricating oil supplied to the bearings and shaft seal element of the low-pressure stage compressor is supplied to the compression cavities of the low-pressure stage compressor, the operating gas compressed by the low-pressure stage compressor is sent together with the oil containing dissolved operating gas to the compression cavities of high-pressure stage compressor to be compressed and discharged from the high pressure stage compressor.

FIG. 5 is a longitudinal sectional view of the conventional two-stage screw compressor mentioned above. In FIG. 5, reference numeral 01 is a casing in which main components of the compressor are housed, 02 is a low-pressure stage compressor comprising a male rotor and a female rotor of low-pressure stage, 03 is a high-pressure stage compressor comprising a male rotor and a female rotor of high-pressure stage for further compressing gas compressed in the low-pressure stage compressor. Reference numeral 04 is a common rotor shaft of the male rotor and driven by a drive device not shown in the drawing.

Reference numeral 05 is a mechanical seal, and 06, 07, and 08 are bearings supporting for rotation of the rotor shaft 04 at the inlet side of the low-pressure stage compressor, at the intermediate section between the lower and high-pressure stage compressor, and at the inlet side of the high-pressure stage compressor, respectively. A common female rotor shaft not shown in the drawing is supported by bearings in the same way. Reference numeral 011 is an oil supply port through which lubricating oil h separated from the compressed operating gas discharged from the high-pressure stage compressor in an oil separator not shown in the drawing and containing dissolved operating gas is supplied to the mechanical seal 05 and bearings 06, 07 via an oil passage 012. The oil after lubricated the mechanical seal and bearings is injected into the compression cavities of the low-pressure stage compressor 02 through an oil supply hole 021.

On the other hand, lubricating oil h containing dissolved refrigerant is supplied from said oil separator through an oil supply port 014 to the bearing 08 via an oil passage 015, then injected into the compression cavities of the high-pressure stage compressor 03 through an oil supply hole 017. Reference numeral 018 indicates an inlet port for sucking operating gas r into the low-pressure stage compressor 02. Operating gas compressed in the low-pressure stage compressor 02 is introduced to the high-pressure stage compressor 03 via a gas passage 019, further compressed therein, and discharged from a discharge port 020.

Operating gas flash-evaporated from lubricating oil supplied to the compression cavities of the low-pressure stage compressor affects to reduce volumetric efficiency of the lower and high-pressure stage compressor. Particularly, in the case of two-stage compressor, flow rate of operating gas depends on volumetric efficiency of the low-pressure stage compressor, so influence of supplying lubricating oil containing dissolved operating gas to the compression cavities of the low-pressure stage compressor is significant.

Amounts of operating gas released from lubrication oil increases with decreasing pressure, so operating gas released from lubricating oil significantly affects the volumetric efficiency of the low-pressure stage compressor, and as a result operating gas flow of the two-stage compressor is significantly reduced.

In patent literature 1 (Japanese Patent No. 3653330 is disclosed a refrigerating cycle in which the two-stage screw compressor is composed such that lubricating oil supplied to the low-pressure stage compressor from the oil separator provided in the downstream side from the high-pressure stage compressor is introduced to the intermediate casing of the two-stage compressor, thereby preventing reduction of refrigerating capacity.

Patent literature 1: Japanese Patent No. 3653330

Problems the Invention Aims to Solve

In a conventional two-stage screw compressor as shown in FIG. 5, operating gas flash-evaporated from the lubricating oil injected into a series of compression cavities produced by a pair of meshing rotors of the lower and high-pressure stage compressor as the rotors rotate affects to decrease volumetric and compression efficiency of both the low-pressure stage and high-pressure stage compressors. Particularly, as the flow rate of operating gas is dependent on volumetric efficiency of the low-pressure stage compressor, decrease in volumetric efficiency of the low-pressure stage compressor due to operating gas released from the lubricating oil supplied to the compression cavities by flash evaporation therein is very remarkable.

By the art disclosed in the patent literature 1, there remains still a problem of decreased compression efficiency because operating gas released from the lubricating oil is sucked into compression cavities of the high-pressure stage compressor and compressed in the compression cavities from intermediate pressure to discharge pressure.

The present invention was made in light of the problems mentioned above, and the object of the invention is to provide a lubricating oil supply method and device of two-stage screw compressor capable of preventing decrease in volumetric efficiency induced by returning lubricating oil that has lubricated bearings and shaft seal element to compression cavities of the compressor and capable of reducing lubricating oil supply, further to provide operating method of a refrigerating machine to increase COP.

Means for Solving the Problems

To attain the object, the present invention proposes an oil supply method of supplying operating gas dissolvable lubricating oil to a two-stage screw compressor integrating a low-pressure stage compressor and a high-pressure stage compressor in a compact one unit for compressing operating gas, wherein lubricating oil supplied to bearings and a shaft seal element (hereafter referred to as bearing parts) of the two-stage compressor is supplied to a series of compression cavities produced by a pair of meshing rotors of the high-pressure stage compressor as the rotors rotate after the lubricating oil has lubricated the bearings and shaft seal element.

With the method of supplying lubricating oil, a part of lubricating oil dissolving operating gas having lubricated the bearing parts is injected into the compression cavities of the high-pressure stage compressor and not injected into the low-pressure stage compressor. Therefore, amounts of operation gas released from lubricating oil existing in the compression cavities of the low-pressure stage compressor is halved or further decreased as compared with the conventional method. Further, as lubricating oil is injected into the compression cavities of the higher pressure compressor only, amounts operating gas released from the injected oil existing in the compression cavities is reduced owing to high pressure in the compression cavities, reduction of compression efficiency in the high-pressure stage compressor can be suppressed.

As the lubricating oil is injected only into the compression cavities of the high pressure stage compressor 3 where pressure is high, the total amount of oil supply can be decreased, and amounts of operating gas released from the lubricating oil can be decreased totally.

It is preferable that oil pressure of supplying lubricating oil to the bearing parts is determined to suffice the following formula:

$$P_{oil} \geqq P_{max.int} \times Vi^{K} + P_{loss} + \Delta P$$

where $P_{oil}$: oil supply pressure to the bearing parts, $P_{max.int}$: maximum intermediate pressure, i.e. maximum pressure of operating gas at the suction side of the high-pressure stage compressor in assumable operation condition, Vi: internal volume ratio, i.e. maximum volume of the compression cavity/volume of said compression cavity when the oil supplied to said compression cavity, κ: specific heat ratio of operating gas, $P_{loss}$: pressure loss in the bearing parts, and $\Delta P$: pressure difference required to inject oil through the oil supply hole into said compression cavity.

Volume of a series of cavities produced by the meshing male and female rotors increases in the suction as the rotors rotate to suck operating gas from the inlet port of the rotor casing, and the cavity volume decreases after the volume has reached the maximum volume as the rotors rotate to compress the operating gas captured in the cavities, then the compressed operating gas is discharged from the discharge port of the rotor casing.

In the above formula, internal volume ratio $Vi \geqq 1$, and specific heat ratio of operating gas $\kappa=1.3$ for ammonia refrigerant, for example. Pressure difference required to inject oil through the oil supply hole into the compression cavity $\Delta P$ is usually 3~5 $Kg/cm^2$.

As to position of oil injection into the compression cavities of the high-pressure stage compressor, it is preferable that lubricating oil is injected when pressure in the cavity into which the oil is injected is higher, however, if pressure in the cavity is too high, there is a fear that operating gas in the cavity blows back toward the bearing parts.

By controlling oil supply pressure to the bearing parts to suffice the above formula, lubricating oil can be injected into the compression cavities of the high-pressure stage compressor without occurrence of blow back of operating gas toward the bearing parts.

The invention proposes to apply the lubricating oil supply method to a two-stage screw compressor integrating a low-pressure stage compressor and a high-pressure stage compressor in a compact one unit for compressing operating gas and lubricated with operating gas dissolvable lubricating oil, wherein are provided an oil conduit line for supplying the lubricating oil to the bearing parts in the two-stage compressor, a throttle valve provided to said oil conduit line, and an oil passage which brings the bearing parts in communication with a series of compression cavities produced by a pair of meshing rotors of the high-pressure stage compressor as the rotors rotate.

With the two-stage screw compressor, lubricating oil is supplied to the compression cavities of the high-pressure stage compressor after lubrication of the bearing parts.

A hole for supplying lubricating oil into the compression cavities of the high-pressure stage compressor is preferably provided in the rotor casing, however, the lubricating oil may be supplied from the suction side of the high-pressure stage.

Oil supply pressure to the bearing parts is adjusted by the throttle valve provided to the oil conduit line so that requisite minimum amounts of oil is supplied without inducing occurrence of blow back of lubricating oil and operating gas toward the bearing parts.

As lubricating oil having lubricated the bearing parts is supplied to the compression cavities of the high-pressure stage compressor, operating gas released from lubricating oil in the compression cavities of the low-pressure stage compressor is halved or further decreased as compared with the conventional method, and as amounts of operating gas released from the lubricating oil in the compression cavities of the high-pressure stage compressor because of its higher pressure, power to compress the released gas to no avail is reduced, and as lubricating oil is supplied to high pressure compression cavities, the total amount of oil supply can be decreased, which contributes to the decreasing of amounts of operating gas released from the lubricating oil.

The oil passage bringing the bearing parts in communication with a series of compression cavities may be provided outside of the two-stage compressor as an oil pipe.

It is preferable to provide an oil pump to the oil conduit line. In case the pressure of lubricating oil to be supplied to the low-pressure stage screw compressor is not high enough, the oil will be pressurized by the pump to be supplied to the low pressure side, so that returning pressure of lubricating oil will be adequately increased.

The present invention proposes a method of operating a refrigerating machine comprising a two-stage screw compressor integrating a low-pressure stage compressor and a high-pressure stage compressor in a compact one unit for compressing operating gas and lubricated with operating gas dissolvable lubricating oil, an oil separator, an oil tank, an oil pump, an oil cooler, a condenser, an expansion valve, and an evaporator, wherein the lubricating oil after lubricating the bearing parts to is supplied to a series of compression cavities produced by a pair of meshing rotors of the high-pressure stage compressor as the rotors rotate, and operation of the refrigerating machine is controlled so that evaporation temperature in the evaporator is −35° C. or lower by adjusting opening of the expansion valve.

The lower the evaporating temperature of operating gas is, the smaller the specific gravity is, and heat capacity of suction gas per unit volume decreases. Therefore, when operating gas is dissolved in lubricating oil, proportion of operating gas flash evaporated from lubricating oil flown out from the bearing parts and mixed in the suction gas increases. Therefore, suction gas is heated more easily by lubricating oil in the suction chamber, flow rate of suction gas decreases, and volumetric efficiency of the low-pressure stage compressor tends to reduce as evaporation temperature lowers. When oil injection to the compression cavities of the low-pressure stage compressor is done, volumetric efficiency thereof is further decreased.

According to the operation method, by supplying the lubricating oil having lubricated the bearing parts to the compression cavities of the high-pressure stage compressor only, and said further reduction in volumetric efficiency of the low-pressure stage compressor is prevented.

By applying the operating method to a refrigerating machine performing a refrigerating cycle with evaporating temperature of refrigerant of −35° C. or lower, COP can be increased by 5% as compared with prior art.

Further, the invention proposes a method of operating a refrigerating machine comprising a two-stage screw compressor integrating a low-pressure stage compressor and a high-pressure stage compressor in a compact one unit for compressing operating gas and lubricated with operating gas dissolvable lubricating oil, an oil separator, an oil tank, an oil pump, an oil cooler, a condenser, an expansion valve, and an evaporator, wherein the lubricating oil supplied to the bearing parts is supplied to a series of compression cavities produced by a pair of meshing rotors of the high-pressure stage compressor as the rotors rotate after lubricating the bearing parts, oil supply pressure to the bearing parts is controlled to suffice the formula presented above while monitoring intermediate pressure, i.e. pressure of operating gas at the suction side of the high-pressure stage compressor, and operation of the refrigerating machine is controlled by adjusting opening of the expansion valve or limiting suction pressure of operating gas so that the intermediate pressure does not become excessively high.

With the method, intermediate pressure is monitored and lubricating oil supply to the bearing parts is controlled to suffice the formula presented above, and the refrigerating machine can be operated so that the intermediate pressure does not become excessively high by adjusting opening of the expansion valve or limiting suction pressure of operating gas.

By applying the method to operation of a refrigerating machine operating a refrigerating cycle with evaporating temperature of refrigerant of −35° C. or lower, COP can be increased by 5% as compared with prior art.

EFFECT OF THE INVENTION

According to the oil supply method of the invention, lubricating oil supplied to the bearing parts of the compressor is introduced to the compression cavities of the high-pressure stage compressor after lubricating the bearing parts, influence of operating gas released by flash evaporation from the lubricating oil injected into the compression cavities is limited only to the high-pressure stage compressor and amounts of the released gas is reduced, so volumetric efficiency is considerably increased as compared with the conventional oil supply method, and compression efficiency can be increased.

By controlling lubricating oil supply pressure to the bearing parts of the compressor to suffice the formula presented above, oil injection into the compression cavities of the high-pressure stage compressor can be performed without inducing occurrence of blow back of operating gas from the compression cavities toward the bearing parts.

According to the two-stage screw compressor of the invention, an oil conduit line for supplying the lubricating oil to the bearing parts in the two-stage compressor, a throttle valve provided to said oil conduit line, and an oil passage which brings the bearing parts in communication with a series of compression cavities produced by a pair of meshing rotors of the high-pressure stage compressor as the rotors rotate, are provided, and preferably an oil pump is provided to the oil conduit line, and lubricating oil supplied to the bearing parts is injected into the compression cavities of the high-pressure stage compressor after lubricating the bearing parts, so influence of operating gas released by flash evaporation from the lubricating oil injected into the compression cavities is limited only to the high-pressure stage compressor and amounts of the released gas is reduced and volumetric efficiency is considerably increased as compared with the conventional oil supply method, as a result compression efficiency can be increased.

Further, preferably the oil passage bringing the bearing parts in communication with a series of compression cavities is provided outside of the two-stage compressor as an oil pipe. By this, whether lubricating oil is flowing or not can be confirmed by surface temperature of the pipe or noise generated by the flowing oil. When oil flow in the pipe is not sufficient, surface temperature of the pipe decreases, so as to be recognized without delay.

According to the method of operating a refrigerating machine, by injecting the lubricating oil after lubrication of the bearing parts of the two-stage compressor into the compression cavities of the high-pressure stage compressor and operating the refrigerating machine so that evaporating temperature in the evaporator is −35° C. or lower by controlling the opening of the expansion valve, COP can be increased by 5% as compared with the conventional method.

According to the method of operating a refrigerating machine, by injecting the lubricating oil after lubrication of the bearing parts of the two-stage compressor into the compression cavities of the high-pressure stage compressor only, decrease in volumetric efficiency of the low-pressure stage compressor is eliminated, and by supplying lubricating oil to the bearing parts of the compressor at a pressure that suffices the formula presented before while monitoring intermediate pressure and controlling opening of the expansion valve or limiting suction pressure so that the intermediate pressure does not rises excessively high, blow back of operating gas from the compression cavities of the high-pressure stage compressor toward the bearing parts can be prevented evading injection of lubricating oil to the compression cavities of the high-pressure stage compressor at excessively high pressure, and COP can be increased by 5% as compared with the conventional method.

EXPLANATION OF REFERENCE NUMERALS

Figure 1:
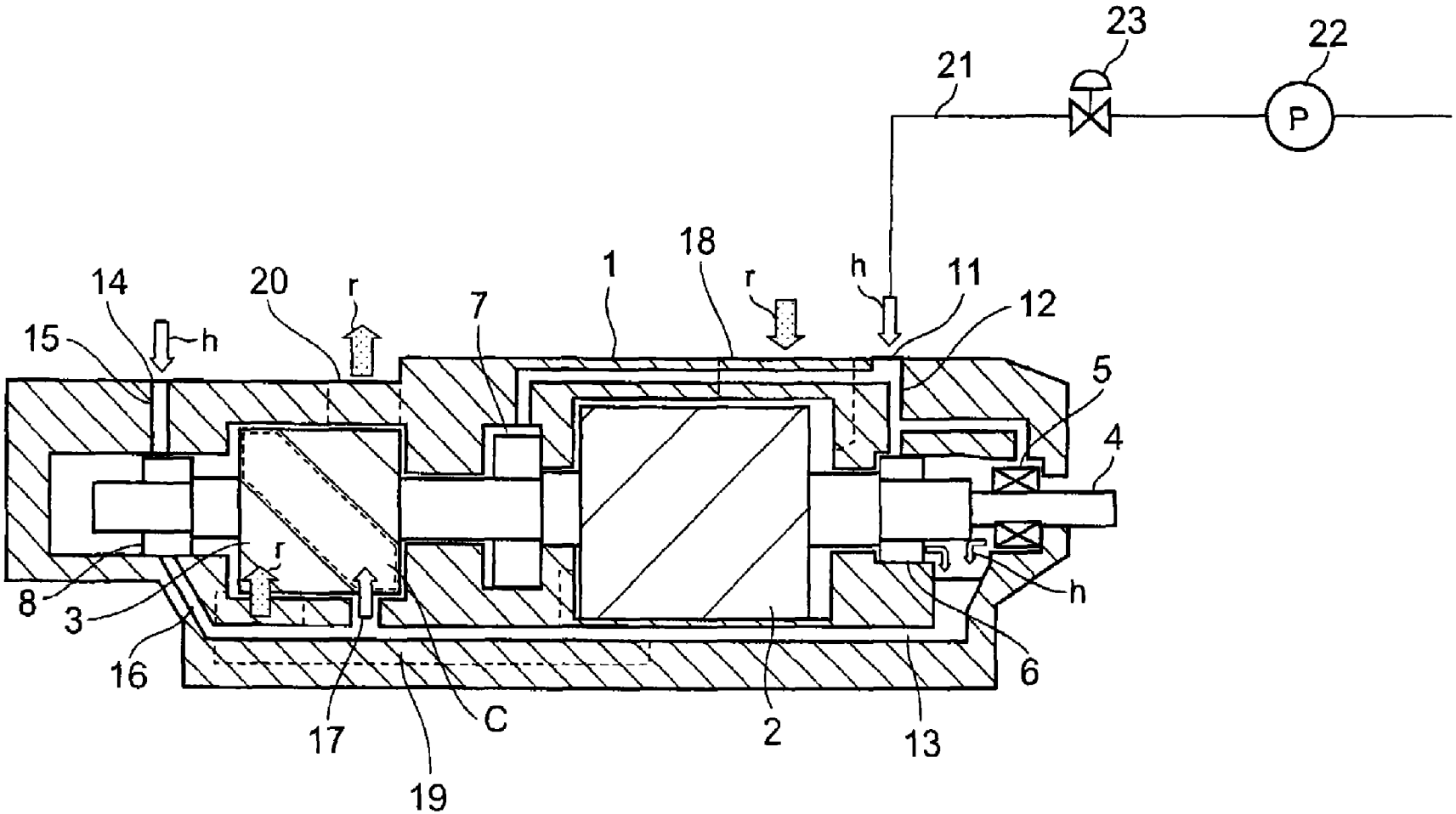
FIG. 1 is a schematic longitudinal sectional view of the first embodiment of two-stage screw compressor of the present invention.

1 Casing,
2 Low-pressure stage compressor
3 High-pressure stage compressor
4 Rotor shaft
5 Mechanical seal (seal element)
6, 7, and 8 Bearings,
11, 14 Oil supply ports
12, 13, 15, 16 Oil passage
17 Oil supply hole
18 Operating gas inlet port
19 Operating gas passage
20 Operating gas discharge port
21, 41 Oil supply pipe
22, 36 Oil pump
23 Throttle valve
31 Two-stage screw compressor
32 Electric motor
32*a* Output shaft
33 Coupling
34 Oil separator
35 tank
37 Oil cooler
38 Condenser
39 Expansion valve
40 Evaporator
c Compression cavity

MODE FOR CARRYING OUT THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 2:
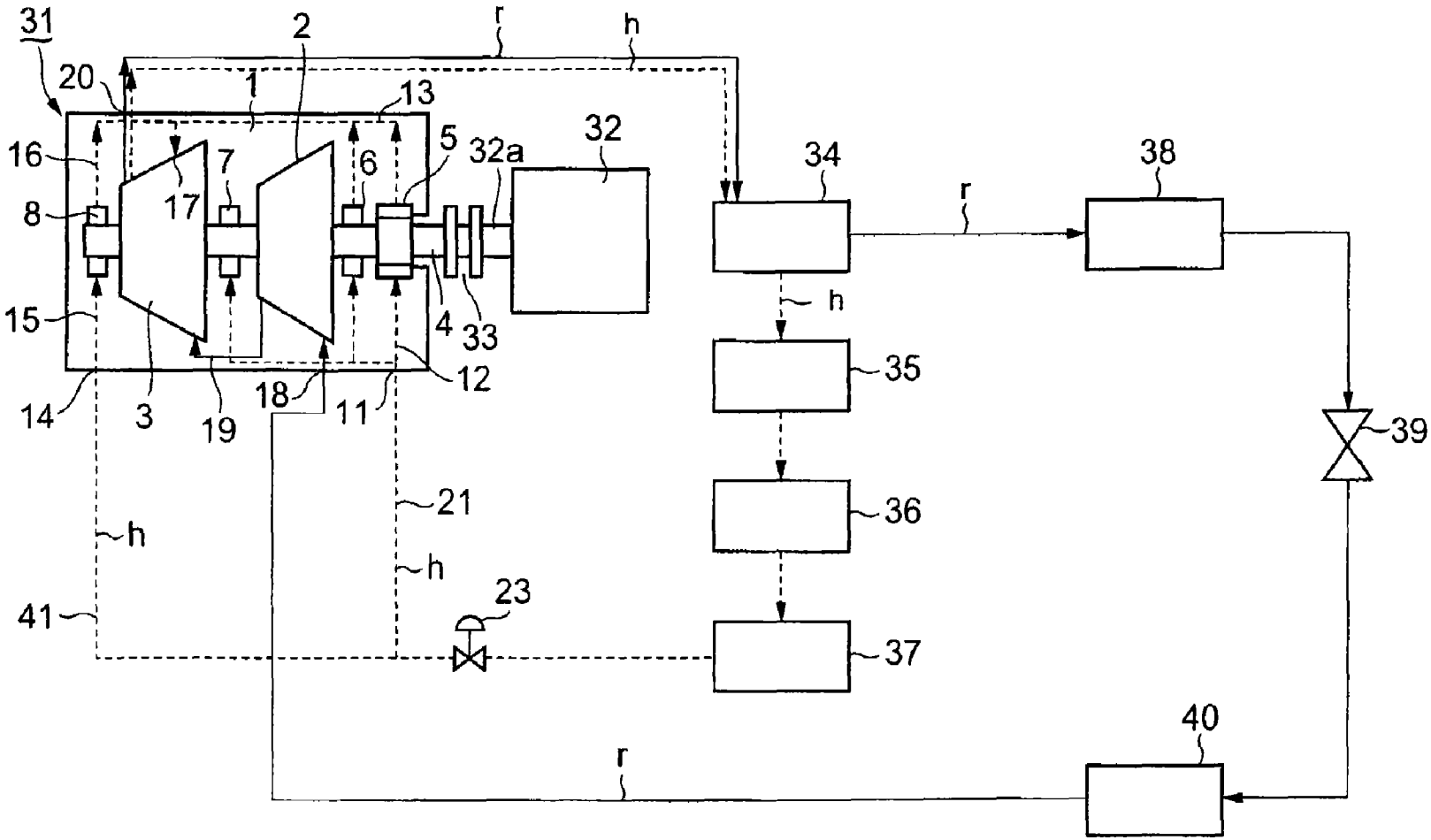
FIG. 2 is a schematic construction showing the second embodiment of the invention.
Figure 3:
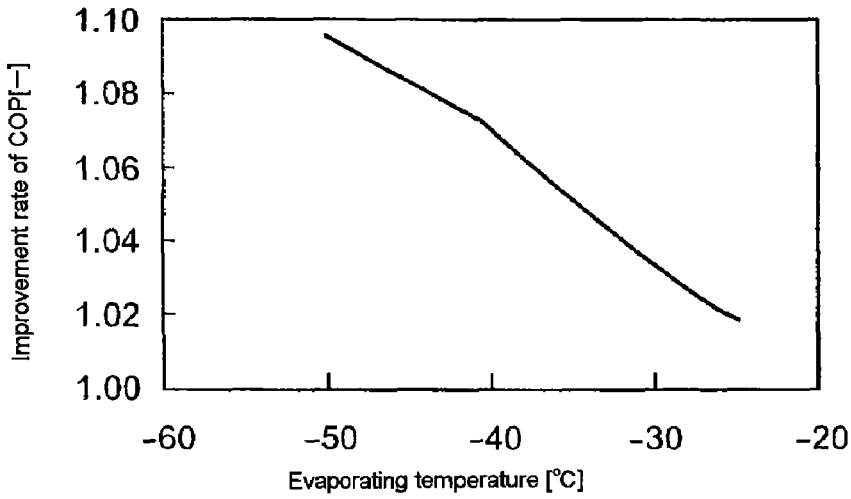
FIG. 3 is a graph showing improvement in COP in the second embodiment.

FIG. 1 is a schematic longitudinal sectional view of the first embodiment of two-stage screw compressor of the present invention, FIG. 2 is a schematic construction showing the second embodiment of the invention, and FIG. 3 is a graph showing improvement in COP in the second embodiment.

The First Embodiment

Referring to FIG. 1 showing a first embodiment of the invention, reference numeral 1 is a casing housing male and female rotors of a low-pressure stage compressor 2 and male and female rotors of a high-pressure stage compressor 3. Reference numeral 4 is a common rotor shaft connecting the male rotors of the lower and higher pressure compressors 2 and 3. The rotor shaft 4 is connected to an electric motor not shown in the drawing at the suction side of the low-pressure stage compressor. Reference numeral 5 is a shaft seal element (mechanical seal), 6~8 are bearings supporting the rotor shaft 4 for rotation at the suction side of the low-pressure stage compressor, at the intermediate part between the lower and higher pressure compressors, and at the suction side of the high-pressure stage compressor. A common female rotor shaft not shown in the drawing is supported by bearings in the same way.

Reference numeral 11 is an oil supply port for supplying lubricating oil h to the mechanical seal 5, bearings 6 and 7 at the suction side of the low-pressure stage compressor and intermediate part respectively via an oil passage 12. Reference numeral 14 is an oil supply port for supplying lubricating oil h to the bearing 8 at the suction side of the high-pressure stage compressor via an oil passage 15. Reference numeral 13 is an oil passage for introducing lubricating oil h lubricated the mechanical seal 5 and bearing 6 to an oil supply hole 17 provided in the casing of the high-pressure stage compressor 3 to inject the oil into the compression cavities thereof. Reference numeral 16 is an oil passage to introduce lubricating oil h lubricated the bearing 8 to an oil supply hole 17. Lubricating oil supplied to the bearing 7 at the intermediate section intrudes into the suction part of the casing of the high-pressure stage compressor 3 after lubrication of the bearing 7.

Lubricating oil h is supplied from an oil separator not shown in the drawing located in the downstream side from the operating gas discharge port of the high pressure stage compressor 3, and the lubricating oil h contains operating gas dissolved therein.

Reference numeral 18 indicates an inlet port for sucking operating gas r into the low-pressure stage compressor 2. Operating gas compressed in the low-pressure stage compressor 2 is introduced to the high-pressure stage compressor 3 via a gas passage 19, further compressed therein, and discharged from a discharge port 20.

In the suction process of the screw compressor, meshing and rotation of the two helical rotors produces a series of volume-increasing cavities into which operating gas is drawn through the inlet port in the casing as the rotors rotate, and when the cavity volume reaches a maximum, each of the cavities is shut away from the inlet opening, then meshing and rotation of the two helical rotors produces a series of volume-reducing cavities as the rotors rotate. Gas drawn in through the inlet port and captured in a cavity is compressed as the cavity reduces in volume, and then discharged through another port in the casing as the rotors further rotate.

The oil supply hole 17 is located at a portion of the casing so that lubricating oil h flowing in the oil passage 13 (16) is injected into each of the compression cavities when the cavity c is reduced in volume, that is, the cavity is under compression process.

It is preferable that the oil supply hole 17 is located so that lubricating oil h is injected into the cavity when pressure in the cavity is high, that is, when the internal volume ratio Vi of the cavity c is large, because amounts of operating gas released from the lubricating oil injected into the cavity is reduced due to high pressure in the cavity and volumetric and compression efficiency of the high-pressure stage compressor, but if the pressure in the cavity is too high, blow back of the operating gas in the cavity toward the bearings and shaft seal element side occurs.

It is necessary that pressure of lubricating oil h supplied to the bearings and shaft seal element (bearing parts) suffices the following formula in order to evade blow back of operating gas at the oil supply hole 17 toward the bearing parts.

$$P_{oil} \geqq P_{max.int} \times Vi^{\kappa} + P_{loss} + \Delta P$$

where $P_{oil}$: oil supply pressure to the bearing parts, $P_{max.int}$: maximum intermediate pressure, i.e. maximum pressure operating gas at the suction side of the high-pressure stage compressor in assumable operation condition, Vi: internal volume ratio, i.e. maximum volume of a compression cavity in suction process as mentioned above/volume of said compression cavity when the oil supply hole 17 communicates with said compression cavity, κ: specific heat ratio of operating gas, $P_{loss}$: pressure loss in the bearing parts, and ΔP: pressure difference required to inject oil through the oil supply hole 17 into said compression cavity.

In the above formula, volume ratio Vi≧1, and κ=1.3 for example when operating gas is ammonia refrigerant. Required pressure difference ΔP is usually 3~5 Kg/cm$^2$.

By supplying lubricating oil to the bearing parts at a pressure that suffices the above formula, lubricating oil can be supplied to the compression cavities of the high-pressure stage compressor 3 at a considerably higher pressure than that of intermediate pressure without occurrence of blow back of operating gas from the compression cavities toward the bearing parts.

In FIG. 1, reference numeral 21 is an oil supply pipe for introducing lubricating oil to the oil supply port 11. A throttle valve 23 and a pump 22 are provided to the oil supply pipe 21, by which oil supply pressure to the bearing parts can be adjusted so that it suffices the above formula.

According to the first embodiment, lubricating oil is supplied to the bearing parts and the oil having lubricated the bearing parts is supplied to the compression cavities of the high pressure stage compressor 3, negative effect induced by flash-evaporated operating gas released from the mutual dissolving type lubricating oil supplied to the compression cavities is limited to the high pressure stage compressor 3, negative effect thereof to the low-pressure stage compressor 2 can be evaded, and volumetric efficiency of the two-staged screw compressor is significantly increased and compression performance is improved as compared with conventional two-stage compressors.

As pressure in the compression cavities of the high-pressure stage compressor 3 is high, amounts of operating gas released from the lubricating oil existing in the cavities compression of the high-pressure stage compressor decreases, so said negative effect is relatively small in the high pressure stage compressor 3.

Further, as oil injection is done only into the compression cavities of the high pressure stage compressor 3 where pressure is high, the total amount of oil supply can be decreased, and amounts of operating gas released from the lubricating oil can be decreased totally.

By determining pressure of supplying lubricating oil to the bearing parts to suffice the above mentioned formula, enough pressure can be obtained at the oil supply hole 17 for injecting the oil into the compression cavities of the high pressure stage compressor, and blow back of operating gas from the compression cavities does not occur.

The Second Embodiment

Next, a second embodiment of the invention will be explained referring to FIGS. 2 and 3. In the drawings, reference numeral 31 is a two-stage screw compressor. The compressor is composed the same as the screw compressor of FIG. 1, and constituents the same as those of the compressor of FIG. 1 is denoted by the same reference numerals, and explanation is omitted.

Reference numeral 32 is an electric motor for driving the common rotor shaft 4 of the lower pressure and high-pressure stage compressor 2 and 3. A drive shaft 32*a* of the motor 32 is connected to the common rotor shaft 4 by means of a coupling 33. Reference symbol r indicates a refrigerant gas, and h indicates lubricating oil in which refrigerant gas is dissolved. The refrigerant gas r and lubricating oil h is discharged from the discharge port 20 of the high pressure stage compressor 3 together, the lubricating oil h is separated from the refrigerant gas r in an oil separator 34. Then the refrigerant gas r is condensed in a condenser 38, expanded adiabatically through an expansion valve 39, and evaporates in an evaporator 40 receiving heat from refrigeration loads. The evaporated refrigerant is supplied to the two-stage screw compressor 31 to be compressed again.

On the other hand, lubricating oil h separated in the oil separator 34 is introduced to an oil tank 35 and from there sent by means of an oil pump 36 to an oil cooler 37, then to the bearings 6, 7, 8 and shaft seal element 5 adjusted in pressure by the throttle valve 23.

With the construction of the second embodiment, by supplying lubricating oil h to the bearings 6, 7, 8, and seal element 5 by adjusting supply pressure by means of the oil pump 36 and throttle valve 23 so that the supply pressure suffices the above mentioned formula, the lubricating oil can be supplied to the compression cavities c of the high pressure stage compressor without blow back of the operating gas in the cavities toward the bearing parts side.

Operation of refrigerating cycle in the refrigerating machine of the embodiment is performed so that evaporating temperature in the evaporator 40 is below −35° C. by controlling opening of the expansion valve 39. The lower the evaporation temperature of operating gas in the evaporator is, the smaller the specific gravity is, and heat capacity of suction gas per unit volume decreases. Therefore, the suction gas is heated more easily by lubricating oil flowed out from the bearing parts and volumetric efficiency of the low-pressure stage compressor tends to reduce as evaporation temperature lowers. When oil injection to the compression cavities of the low-pressure stage compressor is done, volumetric efficiency thereof is further decreased.

According to the embodiment, by returning the lubricating oil having lubricated the bearings 6, 8, and shaft seal element 5 to the compression cavities c of the high-pressure stage compressor 3 only, said further reduction in volumetric efficiency of the low-pressure stage compressor 2 is prevented. Therefore, the lower the evaporating temperature is, the more remarkable the improvement by the invention in refrigeration efficiency is.

FIG. 3 is a graph showing a result of a test in which ammonia and polyalkylene glycol type lubricating oil (mutual dissolving lube oil) are used as a refrigerant and lubricating oil, and relation between evaporating temperature and COP improvement was investigated under operating condition of 3550 rpm and Condensing Temperature (Tc)=35° C. It is recognized from the graph that when evaporation temperature is −35° C. or below, COP is increased by more than 5%. In this test, lubricating oil after lubricated the bearing parts is supplied to the compression cavities c of the high pressure stage compressor when internal volume ratio Vi is in a range of 1.2~1.6.

From FIG. 3, it is recognized that the lower the evaporating temperature, the higher the improvement rate of COP.

Figure 4:
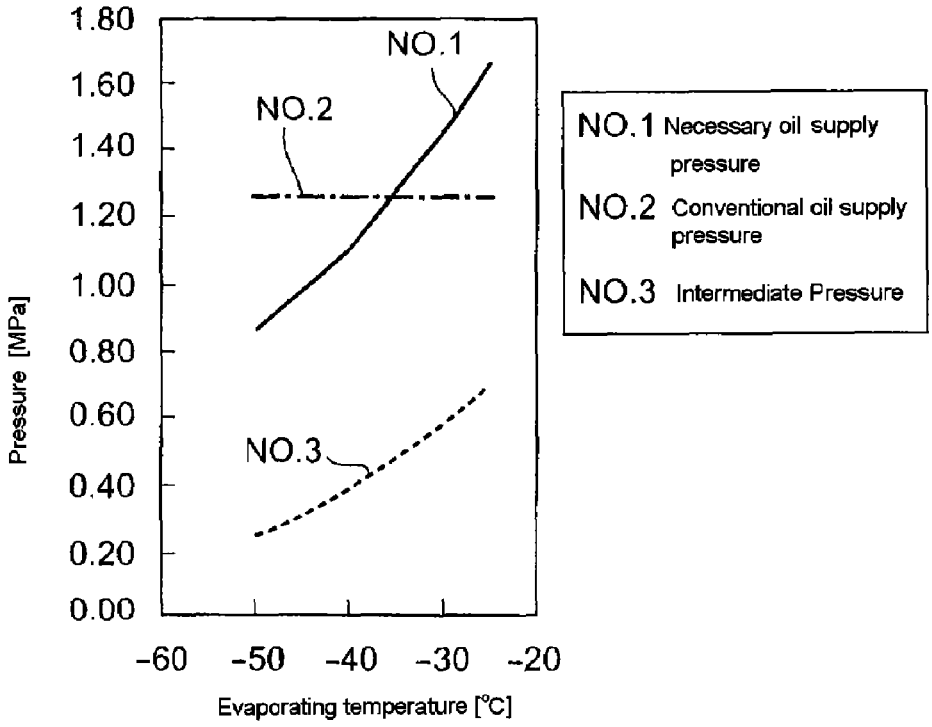
FIG. 4 is a graph showing pressure of lubricating oil supplied to the bearings and shaft seal element of the compressor in the second embodiment.
Figure 5:
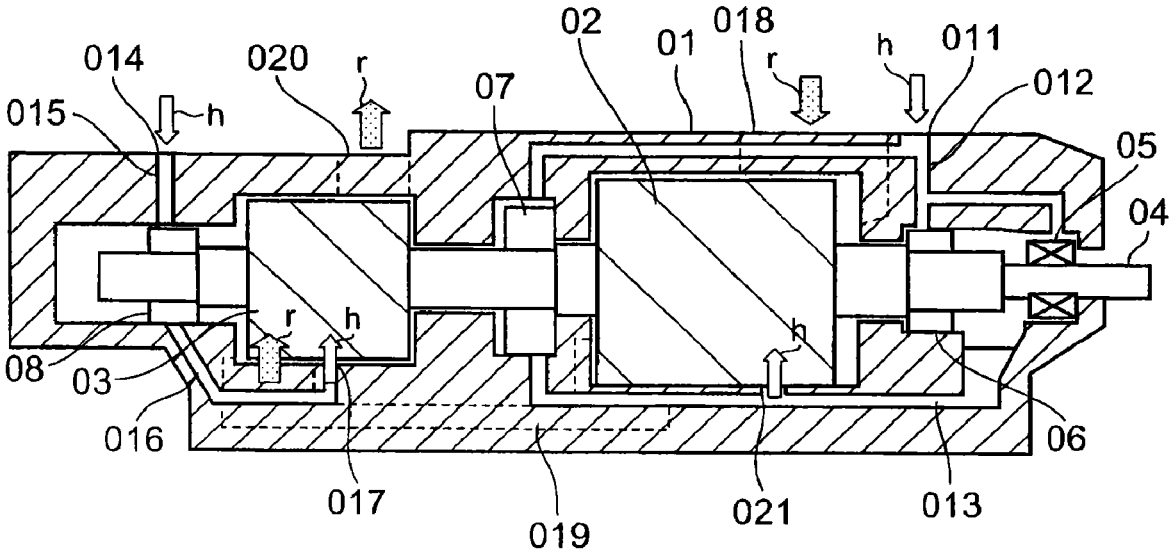
FIG. 5 is a schematic longitudinal sectional view of the conventional two-stage screw compressor.

FIG. 4 is a graph showing lubricating oil supply pressure required in the above mentioned test and that in a conventional two-stage screw compressor. In the drawing, intermediate pressure is pressure of operating gas at the suction side of the high-pressure stage compressor as mentioned before. In the conventional oil supply method, oil supply to the bearing parts is done by pressure difference between pressure in the oil separator located in the downstream side from the discharge port of the high-pressure stage compressor and that at the bearing parts, so assuming pressure loss in the oil supply path as 0.1 MPa, Conventional oil supply pressure≈discharge pressure of operating gas from the high-pressure stage−0.1 MPa As can be recognized from FIG. 4, conventional oil supply pressure (curve No. 2) falls short for supplying oil to the bearing parts when evaporation temperature is above −35° C., so blow back of operating gas from the oil supply hole 17 toward the bearing parts side will occur.

According to the invention, to prevent occurrence of this blow back of operating gas, operation is controlled by adjusting opening of the expansion valve or limiting suction pressure of operating gas so that intermediate pressure does not become excessively high while monitoring the intermediate pressure, and oil supply pressure is controlled to be higher than necessary oil pressure (curve No. 1) based on the formula presented before. For example, oil supply pressure is maintained at a sufficiently high pressure of 2.0 MPa in the case of FIG. 4.

By controlling like this, returning pressure of lubricating oil to the compression cavities of the high-pressure stage compressor does not become excessively high while evading blow back of operating gas toward the bearing parts side. Further, COP can be increased by 5% or over as compared with the conventional two-stage screw compressor by lowering evaporating pressure to −35° C. or lower.

Figure 6:
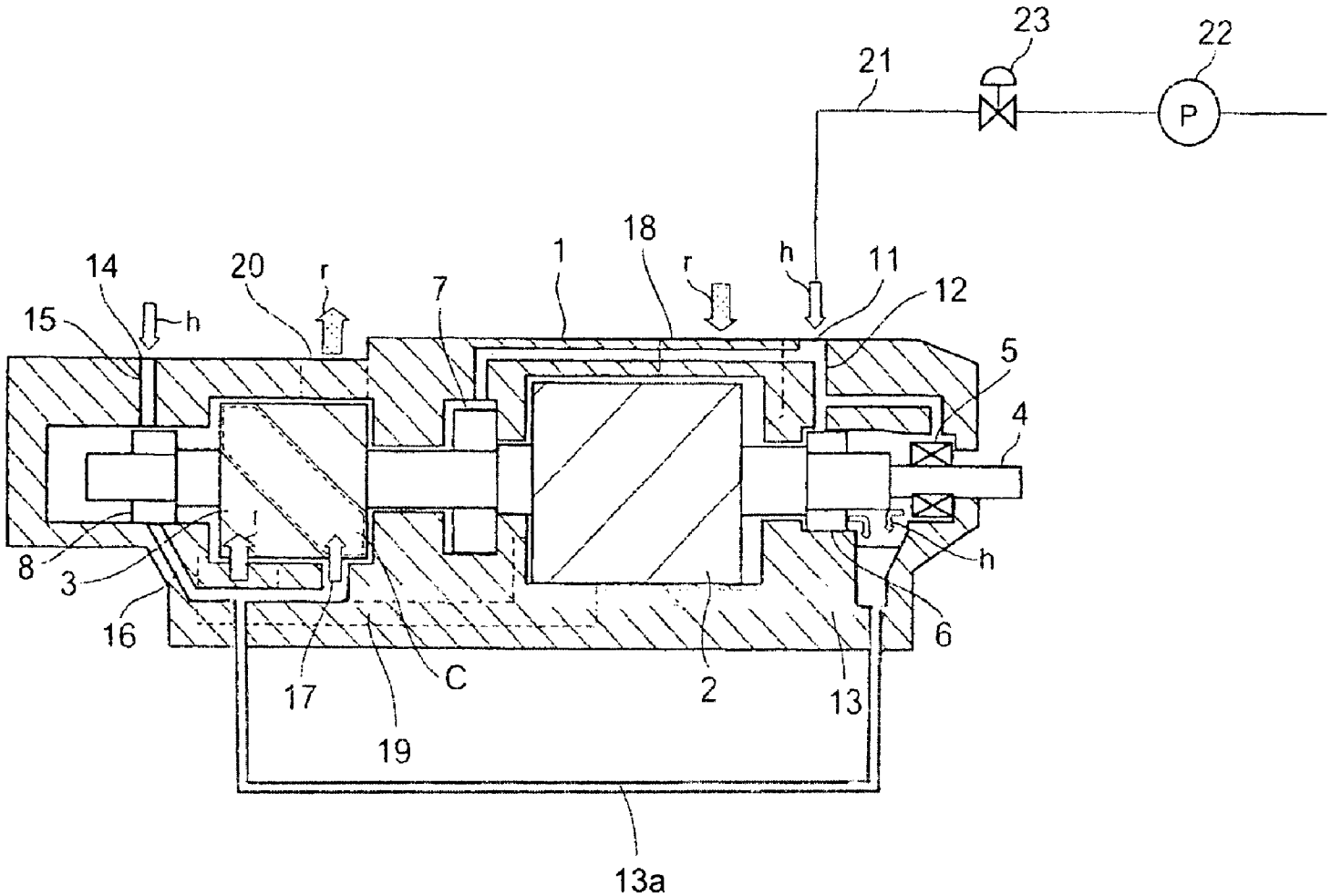
FIG. 6 is a schematic longitudinal sectional view of an alternative embodiment of the two-stage screw compressor shown in FIG. 1.

Referring to FIG. 6, there is shown alternative embodiment of the two-stage screw compressor of FIG. 1. All of the elements of these two embodiments are identical with the exception that oil passage 13 shown in FIG. 1 has been replaced with an external pipe 13*a* in FIG. 6. It is preferred that the oil passage bringing the bearing parts in communication with the series of compression cavities is an oil pipe 13*a* located outside of the two-stage compressor. With an external oil pipe 13*a*, whether lubricating oil is flowing or not can be determined by surface temperature of the pipe or noise generated by the flowing oil. When oil flow in the pipe is not sufficient, surface temperature of the pipe decreases.

INDUSTRIAL APPLICABILITY

According to the present invention, compression efficiency of two-stage screw compressor can be considerably increased as compared with conventional oil supply method only by slightly modifying lubricating oil supply method and construction. By applying a two-stage screw compressor according to the invention to a refrigerating apparatus, refrigerating capacity can be increased.

What is claimed is:

1. An oil supply method of supplying operating gas dissolvable lubricating oil to a two-stage screw compressor integrating a low-pressure stage compressor and a high-pressure stage compressor in a compact one unit for compressing operating gas, wherein lubricating oil supplied to bearings and a shaft seal element of the two-stage compressor is supplied to a series of compression cavities produced by a pair of meshing rotors of the high-pressure stage compressor as the rotors rotate after the lubricating oil has lubricated the bearings and the shaft seal element, and the lubricating oil is supplied to the compression cavities at a position where the internal volume ratio Vi of the compression cavities is larger than 1 (not including 1), where Vi=maximum volume of the compression cavity/volume of said compression cavity when the oil is supplied to said compression cavity, wherein oil pressure of supplying said lubricating oil to the bearings and the shaft seal element is determined to suffice the following formula:

$$P_{high} > P_{oil} \geqq P_{max.int} \times Vi^{\kappa} 0.3 \sim 0.5 \text{ MPa}$$

where $P_{high}$: discharge pressure of operating gas from the high-pressure stage compressor, $P_{oil}$: oil supply pressure to the bearings and the shaft seal element, $P_{max.int}$: maximum intermediate pressure, i.e. maximum pressure of operating gas at the suction side of the high-pressure stage compressor in assumable operation condition, Vi: internal volume ratio, i.e. maximum volume of the compression cavity/volume of said compression cavity when the oil is supplied to said compression cavity, κ: specific heat ratio of operating gas, $P_{loss}$: pressure loss in the bearings and the shaft seal element.

2. A method of operating a refrigerating machine comprising a two-stage screw compressor integrating a low-pressure stage compressor and a high-pressure stage compressor in a compact one unit for compressing operating gas and lubricated with operating gas dissolvable lubricating oil, an oil separator, an oil tank, an oil pump, an oil cooler, a condenser, an expansion valve, and an evaporator, wherein the lubricating oil supplied to the bearings and the shaft seal element is supplied after lubricating the bearings and the shaft seal element to a series of compression cavities produced by a pair of meshing rotors of the high-pressure stage compressor as the rotors rotate at a position where the internal volume ratio Vi of the compression cavities is larger than 1 (not including 1), where Vi=maximum volume of the compression cavity/volume of said compression cavity when the oil is supplied to said compression cavity;

oil supply pressure to the bearings and the shaft seal element is controlled to suffice the following formula while monitoring intermediate pressure, i.e. pressure of operating gas at the suction side of the high-pressure stage compressor, said formula for determining supply pressure to the bearings and the shaft seal element being, $$P_{high} > P_{oil} \geqq P_{max.int} \times Vi^{\kappa} 0.30 \sim 0.5 \text{ MPa}$$

where $P_{high}$: discharge pressure of operating gas from the high-pressure stage compressor, $P_{oil}$: oil supply pressure to the bearings and the shaft seal element, $P_{max.int}$: maximum intermediate pressure, i.e. maximum pressure of operating gas at the suction side of the high-pressure stage compressor in assumable operation condition, Vi: internal volume ratio, i.e. maximum volume of the compression cavity/volume of said compression cavity when the oil is supplied to said compression cavity, κ: specific heat ratio of operating gas, $P_{loss}$: pressure loss in the bearings and the shaft seal element; and operation of the refrigerating machine is controlled by adjusting opening of the expansion valve or limiting suction pressure of operating gas so that the intermediate pressure does not become excessively high.

* * * * *